US005984030A

United States Patent [19]

Larsson et al.

[11] Patent Number: 5,984,030

[45] Date of Patent: Nov. 16, 1999

[54] ROCK DRILLING TOOL, DRILL BIT AND A METHOD OF TRANSFERRING PERCUSSIVE ENERGY

[75] Inventors: Kenneth Larsson, Sandviken, Sweden; Rainer Beccu, Houston, Tex.

[73] Assignee: Sandvik AB, Sandviken, Sweden

[21] Appl. No.: 08/913,286

[22] PCT Filed: Mar. 21, 1996

[86] PCT No.: PCT/SE96/00352

§ 371 Date: Sep. 11, 1997

§ 102(e) Date: Sep. 11, 1997

[87] PCT Pub. No.: WO96/30620

PCT Pub. Date: Oct. 3, 1996

[30] Foreign Application Priority Data

Mar. 27, 1995 [SE] Sweden ..... 9501096

[51] Int. Cl.[6] ..... E21B 10/36

[52] U.S. Cl. ..... 175/414; 175/415; 299/100

[58] Field of Search ..... 175/414, 415, 175/420.1, 426; 299/100

[56] References Cited

U.S. PATENT DOCUMENTS

| | | | |
|---|---|---|---|
| 1,477,855 | 4/1923 | Thurston . | |
| 4,968,068 | 11/1990 | Larsson | 285/390 |
| 5,595,252 | 1/1997 | O'Hanlon | 175/57 |
| 5,699,867 | 12/1997 | Jones | 175/296 |
| 5,794,728 | 8/1998 | Palmberg | 175/400 |

FOREIGN PATENT DOCUMENTS

| | | |
|---|---|---|
| 0 100 437 A2 | 6/1983 | European Pat. Off. . |
| 0 354 887 | 6/1989 | European Pat. Off. . |

*Primary Examiner*—David Bagnell
*Assistant Examiner*—Chi H. Kang
*Attorney, Agent, or Firm*—Burns, Doane, Swecker & Mathis, L.L.P.

[57] ABSTRACT

A rock drilling tool for percussive drilling includes a drill bit and a drill tube cooperating by means of shoulder abutment in a threaded connection. The connection includes at least one male thread and a female thread. The male thread is provided on a shank being an integral part of the drill bit. The drill bit is provided with a shoulder at the inner end of the shank, the shoulder having an abutment surface facing towards the free end of the shank. The female thread is provided in the drill tube and the free end of the drill tube is provided with an impact surface. The threads are cylindrical. The combination of shoulder abutment with a short head provides straight energy transfer at a rock drilling tool.

18 Claims, 4 Drawing Sheets

ROCK DRILLING TOOL, DRILL BIT AND A METHOD OF TRANSFERRING PERCUSSIVE ENERGY

TECHNICAL BACKGROUND

The present invention relates to a rock drilling tool for percussive drilling comprising a drill bit and a drill tube. The drill bit has a head having a front surface wherefrom a number of front inserts are project and peripheral inserts provided in a peripheral row. The drill bit is provided with a first thread co-operating with a second thread provided on the drill tube. The invention further relates to a drill bit and a method of transferring percussive energy from a rock drilling tool to a bore hole.

It is previously known through U.S. Pat. No. 1,447,855 to provide a so called shoulder abutment at threaded connections between a drill rod and a rock drill bit in equipment for percussive drilling. When loosening the drill bit in the known equipment with a relatively heavy drill bit, there is a risk that the thread entrance on the bit shank will become damaged due to the substantial difference in mass on opposite sides of the shoulder abutment. Furthermore, the known drill bit is provided with chisel edges of hardened steel, which project relatively far in the radial direction. This means that the percussive energy during percussive drilling is forced to deflect towards the radially outer tip of the edge and therefore the effective coefficient of efficiency decreases, thereby resulting in impaired guiding ability and impaired drilling speed. Chisel edges give a relatively slow drilling speed. Furthermore it seems as the known tool can have abutment between the drill rod and bit, both in the radial and axial directions which during drilling create hardening of the material with subsequent crack initiation points.

OBJECTS OF THE INVENTION

An object of the present invention is to provide a method of transferring percussive energy from a rock drilling tool to a drill hole, such as to provide good guidance of the bit, acceptable loads and also a good energy transfer.

Another object of the present invention is to provide a rock drilling tool comprising a rigid connection which does not deflect in spite of difficult angles of attack.

Still another object of the present invention is to provide a rock drilling tool, which has a good, coefficient of efficiency by making the drill bit as light as possible simultaneously as the entrance of the shank is spared, during loosening, due to low bit weight.

Still another object of the present invention is to provide a rock drilling tool, through which connection a good length of life can be achieved simultaneously as the part most frequently changed is easy to handle.

Still another object of the present invention is to provide a rock drilling tool, whose front end of the drill tube does not have a projecting portion and therefore there will be no transport damages.

Still another object of the present invention is to provide an effective rock drill bit.

DESCRIPTION OF THE DRAWING

The objects and advantages of the invention are met by providing a method, a rock drilling tool and a rock drill bit according to the features of the present invention. Below embodiments of the invention will be described in connection with the appended figures.

DETAILED DESCRIPTION OF PREFERRED EMBODIMENTS OF THE INVENTION

Figure 1:
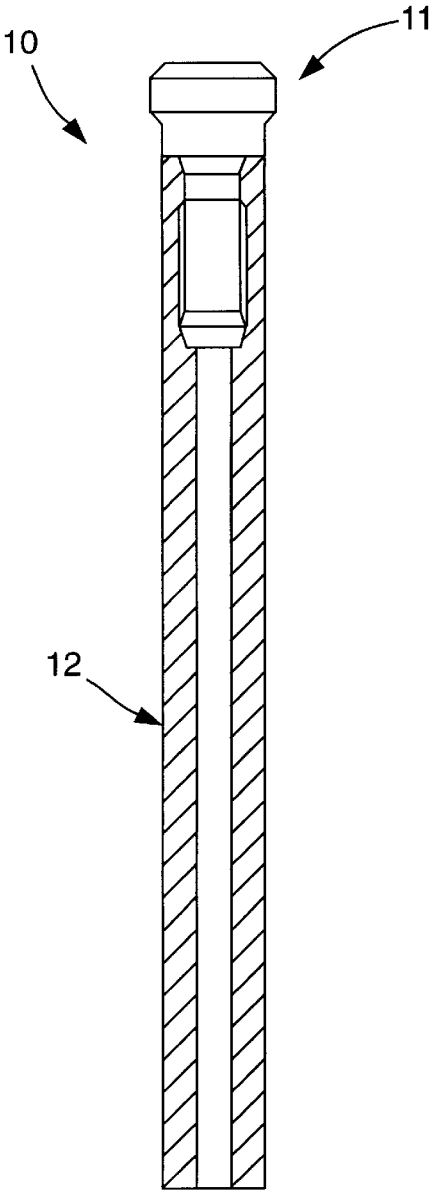
FIGS. 1 to 4 show a schematical, partly sectioned view of a rock drilling tool according to the invention.
Figure 2:
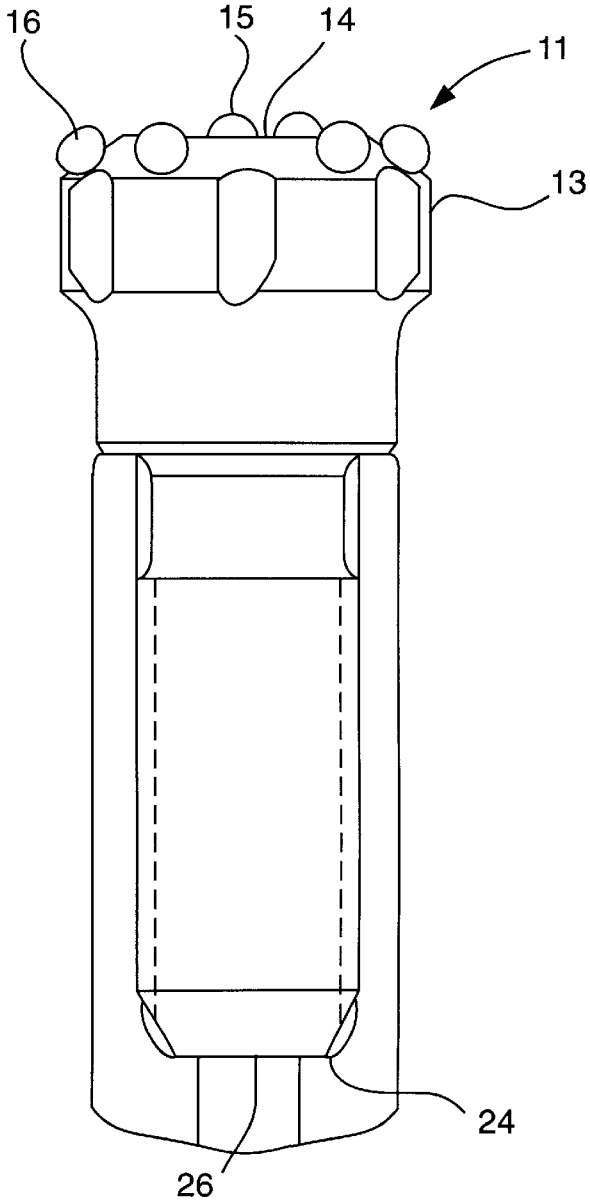
Figure 3:
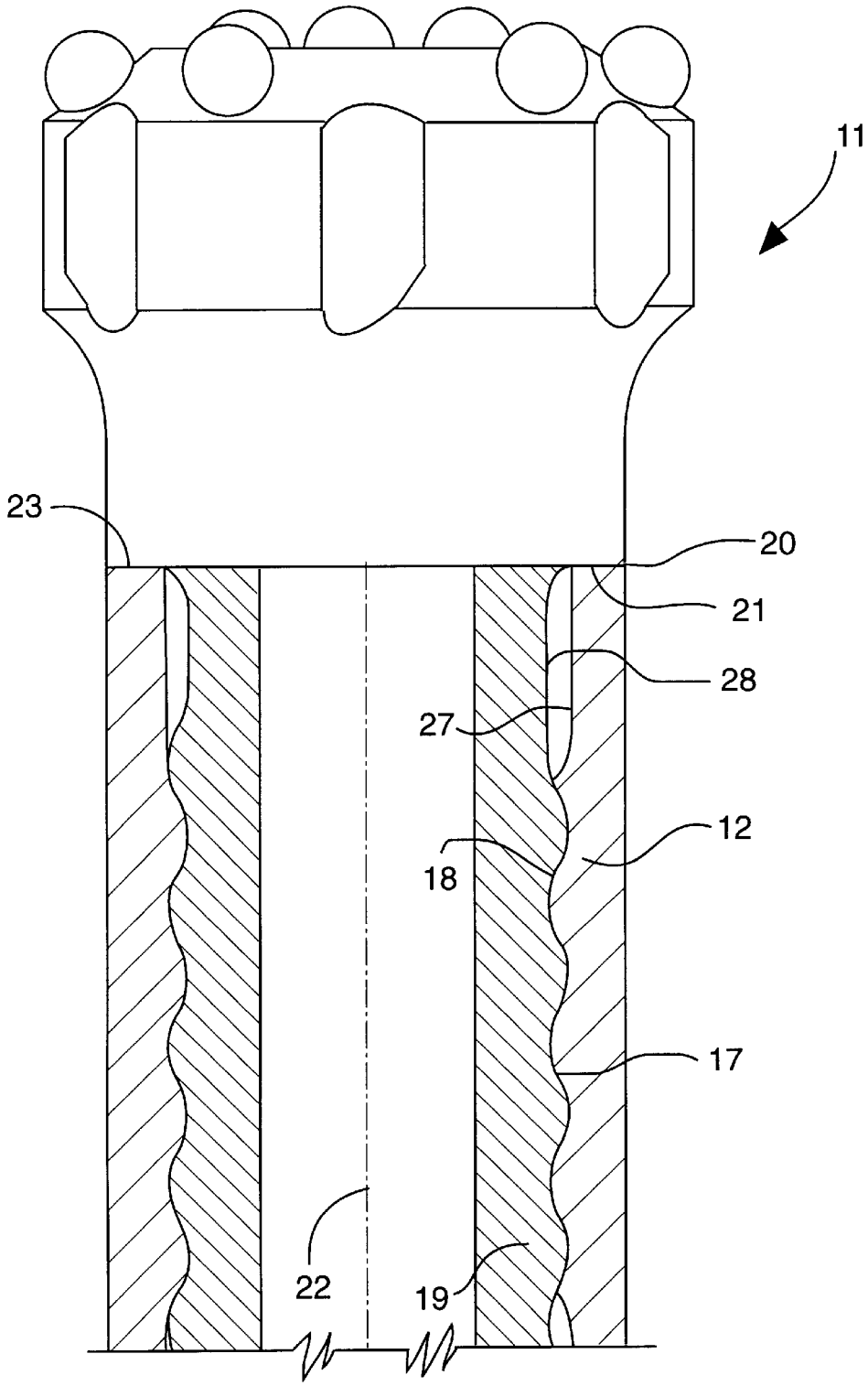

The rock drilling tool 10 as shown in the figures comprises a rock drill bit 11 and a drill tube 12. The bit 11 has a head 13 provided with a front surface 14, wherefrom a number of front inserts 15 projects, and a peripheral row of peripheral inserts 16, preferably provided with spherical or ballistic working surfaces. The drill bit is provided with a male thread 17, which is provided to cooperate with a female thread 18 on the tube.

The male thread 17, which is provided on a shank 19, is an integral part of the percussive drill bit 11. The drill bit is provided with a shoulder at the inner end of the shank 19, which shoulder has a planar abutment surface 21 facing towards the free end of the shank 19. The abutment surface 21 extends perpendicularly relative to a longitudinal center axis 22 of the drill tool 10.

A weight of the head 13 including the inserts is a maximum 2.5 times, preferably less than 2 times the weight of the shank 19 when the parts are separated at the shoulder 20.

The free end of the drill tube 12 has the shape of a planar, hollow end surface 23, which extends perpendicularly relative to the center axis 22.

Figure 6:
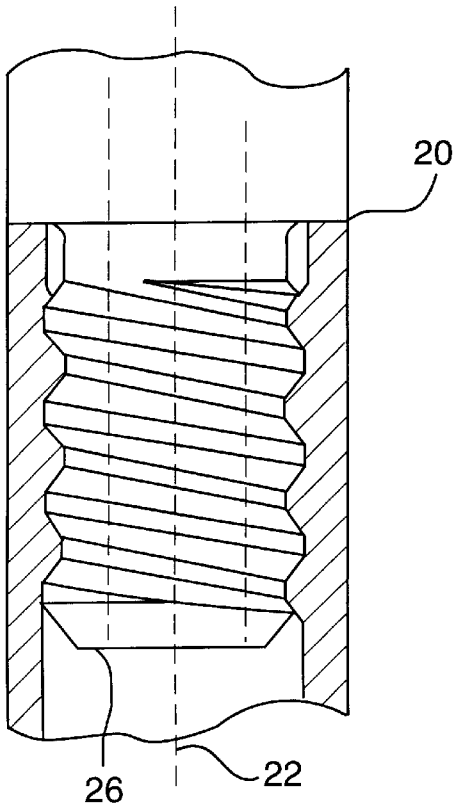
FIGS. 6 and 7 show cross-sections of alternative ends of the female thread.
Figure 7:
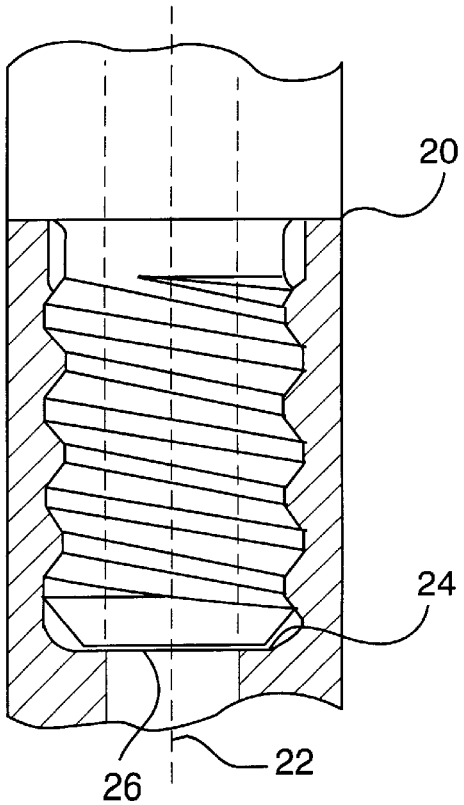

The threaded connection further comprises a female thread 18, which is made in the drill tube as an integral part thereof. The shape of the bottom of the female thread is in most cases adapted to provide optimum strength for the tube as in FIG. 6. Alternatively as in FIG. 7 for instance, the bottom of the female thread may have the shape of a planar surface 24, in which case it is beneficial for it to extend perpendicularly relative to the center axis 22 in the case bottom abutment. In the latter case, the distances between the shoulder abutment and the surface 24 and the end surface 26 of the shank, respectively are such that the latter are in contact with or reach contact later on as the tool is used, such that the area on the bit for straightly directed energy increases. In most cases it is advantageous to provide thread clearances 27 and 28 in connection with the shoulder abutment, to level the bending forces and to avoid abutment in that area between the parts 12 and 19.

The threads 17, 18 may be cylindrical rope threads or cylindrical trapezoidal threads and have a pitch angle of about 5–15°. The rock drilling tool 10 has a central flush channel, which is divided into at least two other channels in the head.

It is apparent from the figures that the abutment surface 21 of the drill bit in active position always abuts against the planar end surface 23 on the free end of the tube, which means that shoulder abutment is established.

Figure 4:
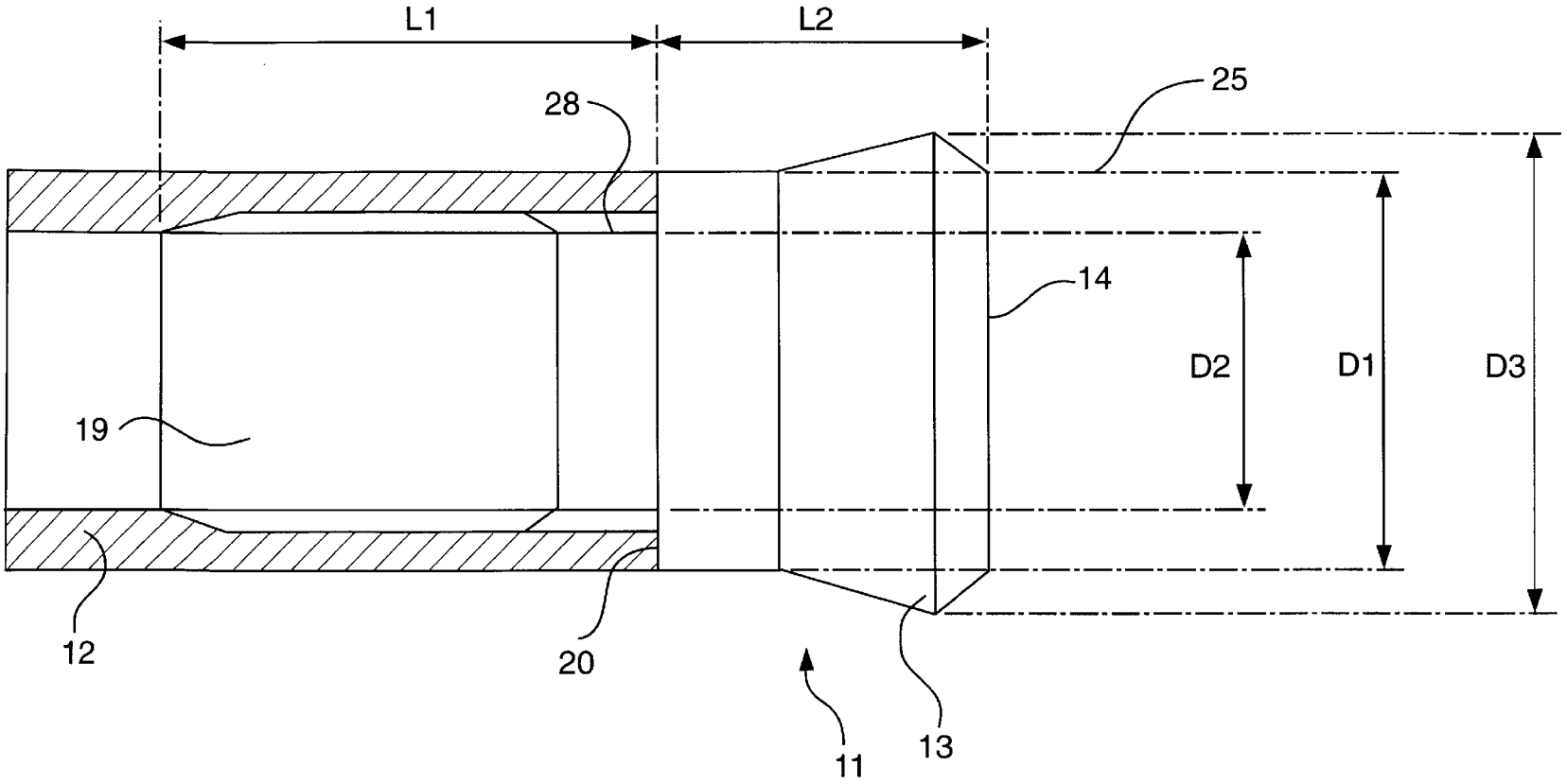

In FIG. 4, schematically shows a rock drilling tool according to the present invention, wherein the axial length from the shoulder 20 to the free end of the shank is L1 and the height of the bit 11 between the shoulder 20 and the front surface 14 is L2. The axial length L2 of the head is 0.2 to 0.9 times, preferably about 0.5 times the axial length L1 of the shank.

Figure 5:
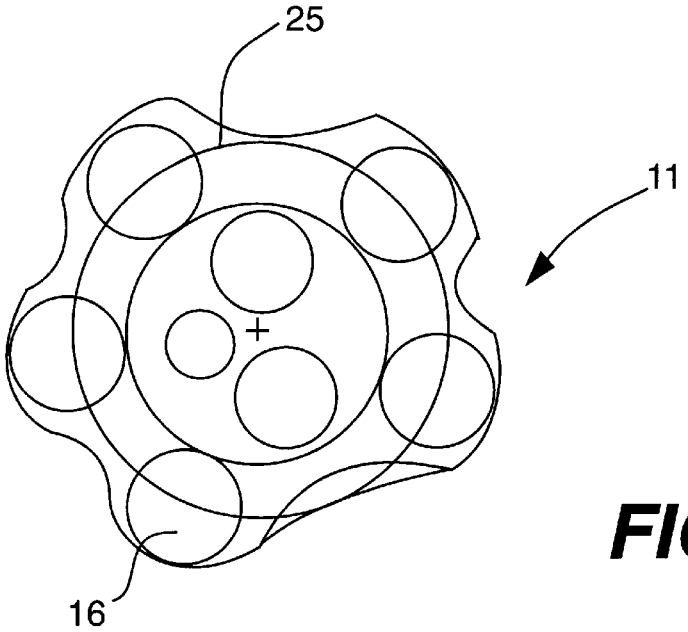
FIG. 5 shows the tool in a top view.

The outer diameter of the drill tube 12 and the shoulder 20 is designated D1 and the smallest outer diameter of the shank is designated D2, which is approximately the same as the smallest diameter of the female thread. The largest diameter of the head 13 is designated D3, which preferably is equal to or somewhat less than the diameter of the circle radially outwardly touching the peripheral inserts 16. The relation D3/D1 is preferably larger than 1 and preferably less than 1.5.The radially outermost part of the shoulder 20 describes according to FIG. 5, a circle having a diameter D1 and forms a cylinder 25 which intersects the peripheral inserts 16 substantially in the middle or in the vicinity of their active working surfaces. The latter forces the percussive energy to where it is most useful, i.e. the impact wave can travel straightly towards the insert without any energy consuming deflections.

The drill tube 12 thus has a substantially constant outer diameter D1 and the axial length L2 of the head is provided shorter than the axial length L1 of the shank. The percussive energy transfers substantially straight from the drill tube to points of contact with the drill hole via inserts 16 by having an imaginary cylinder 25 being an extension of the outer diameter D1 of the shoulder intersecting the peripheral inserts 16.

The present invention is thus characterized by combining shoulder abutment with a short head and straight energy transfer at a rock drilling tool.

We claim:

1. Method of transferring percussive energy from a percussive drilling tool to a bore hole, said method comprising:

providing the percussive drilling tool including a drill tube and a drill bit cooperating by means of at least shoulder abutment in a threaded connection, said connection comprising at least one cylindrical male thread and a cylindrical female thread, said male thread being provided on a shank being an integral part of the drill bit, said drill bit being provided with an abutment surface facing towards the free end of the shank, said female thread being provided in the drill tube and the free end of said drill tube being provided with an impact surface, providing the drill tube with a substantially constant outer diameter and a head of the drill bit with an axial length that is shorter than the axial length of the shank, and transferring the percussive energy substantially straight from the drill tube to points of contact with a bore hole by means of inserts by having an imaginary cylinder being an extension of the outer diameter of a shoulder intersecting the peripheral inserts provided on the head.

2. Percussive rock drilling tool comprising a drill bit and a drill tube co-operating by means of at least shoulder abutment in a threaded connection, said connection comprising at least one male thread and a female thread, said male thread being provided on a shank being an integral part of the drill bit, said drill bit being provided with a shoulder at an inner end of the shank, said shoulder having an abutment surface facing towards a free end of the shank, said female thread being provided in the drill tube and a free end of said drill tube being provided with an impact surface, said threads being cylindrical, wherein the drill bit has a head having a front surface wherefrom a number of front inserts project and that peripheral inserts are arranged in a peripheral row and that the drill tube has a substantially constant outer diameter and that the axial length of the head is shorter than the axial length of the shank and that an imaginary cylinder being an extension of the outer diameter of the shoulder intersects the peripheral inserts.

3. Percussive rock drilling tool according to claim 2, wherein the imaginary cylinder intersects each peripheral insert in the vicinity of an axially outermost part of the imaginary cylinder and the weight of the head is a maximum of 2.5 times the weight of the shank.

4. Percussive rock drilling tool according to claim 3, wherein the weight of the head is less than 2 times the weight of the shank.

5. Percussive rock drilling tool according to claim 2, wherein the axial length of the head is 0.2 to 0.9 times the axial length of the shank.

6. Percussive rock drilling tool according to claim 5, wherein the axial length of the head is about 0.5 times the axial length of the shank.

7. Percussive rock drilling tool according to claim 2, wherein the drill bit is provided with a shoulder at the inner end of the shank, said shoulder having a planar abutment surface facing towards the free end of the shank and that the abutment surface extends perpendicularly relative to a longitudinal center axis of the drill tool.

8. Percussive rock drilling tool according to claim 2, wherein the imaginary cylinder intersects each peripheral insert substantially in a middle of active working surfaces of the insert.

9. Percussive rock drilling tool according to claim 2, wherein the imaginary cylinder intersects each peripheral insert substantially in a vicinity of active working surfaces of the insert.

10. Percussive drill bit comprising:

a head and a shank having a cylindrical male thread, said shank being an integral part of the drill bit, said drill bit being provided with a shoulder at an inner end of the shank, said shoulder having an abutment surface facing towards a free end of the shank, wherein a number of front inserts project from a front surface of the head, peripheral inserts are provided in a peripheral row, an axial length of the head is shorter than an axial length of the shank and an imaginary cylinder being an extension of an outer diameter of the shoulder intersects the peripheral inserts.

11. Percussive drill bit according to claim 10, wherein the imaginary cylinder intersects each peripheral insert in the vicinity of an axially outermost part of the imaginary cylinder.

12. Percussive drill bit according to claim 10, wherein the axial length of the head is 0.2 to 0.9 times the axial length of the shank.

13. Percussive drill bit according to claim 12, wherein the axial length of the head is about 0.5 times the axial length of the shank.

14. Percussive drill bit according to claim 10, wherein the weight of the head is a maximum of 2.5 times the weight of the shank.

15. Percussive drill bit according to claim 14, wherein the weight of the head is less than 2 times the weight of the shank.

16. Percussive drill bit according to claim 10, wherein a thread clearance is provided between the head and the cylindrical male thread.

17. Percussive drill bit according to claim 10, wherein the imaginary cylinder intersects each peripheral insert substantially in a middle of active working surfaces of the insert.

18. Percussive drill bit according to claim 10, wherein the imaginary cylinder intersects each peripheral insert substantially in a vicinity of active working surfaces of the insert.

* * * * *